US005535449A

United States Patent [19]

Dickey

[11] Patent Number: 5,535,449

[45] Date of Patent: Jul. 16, 1996

[54] OUTER WRAP CLOTHING

[76] Inventor: Nancy J. Dickey, 2032 S. Eureka, Springfield, Mo. 65804

[21] Appl. No.: 355,504

[22] Filed: Dec. 14, 1994

Related U.S. Application Data

[63] Continuation-in-part of Ser. No. 23,460, May 25, 1994.

[51] Int. Cl.[6] ..... A41D 11/00

[52] U.S. Cl. ..... 2/69; 2/69.5; 2/75; 2/80; 2/83

[58] Field of Search ..... 2/46, 69, 69.5, 2/75, 80, 83, 84, 105, 106, 113, 114, 115, 88, 89, 48, 49.5, 49.4, 49.3, 49.2, 49.1, 50, 51, 52, 74

[56] References Cited

U.S. PATENT DOCUMENTS

| | | | |
|---|---|---|---|
| 1,292,351 | 1/1919 | Milkes | 2/75 |
| 1,394,213 | 10/1921 | Ohrenstein | 2/75 X |
| 1,497,685 | 6/1924 | Hoyme | 2/114 |
| 1,612,451 | 12/1926 | Lindley | 450/155 X |
| 2,621,336 | 12/1952 | Wendroff | 2/80 X |
| 2,680,850 | 6/1954 | Renard | 2/114 |
| 2,705,326 | 4/1955 | Lahnstein et al. | 2/83 |
| 4,117,840 | 10/1978 | Rasure | 2/69 X |
| 4,726,076 | 2/1988 | Douez | 2/69 |
| 5,274,852 | 1/1994 | Hogan | 2/105 X |

*Primary Examiner*—Jeanette E. Chapman
*Attorney, Agent, or Firm*—Hovey, Williams, Timmons & Collins

[57] ABSTRACT

An article of outer wrap clothing for children includes elongated front and rear panels for covering the front and back of the child, the panels being connected together at the top of the clothing to define shoulders. A head opening is formed between the shoulders for receiving the head of a child, and a hood may be provided adjacent the opening for covering the head of the child when the article is worn. A pair of sleeves extend laterally from the shoulders for covering the arms of the child, the sleeves each including a free end remote from the shoulders and an interior pocket for receiving the arms and hands of the child.

1 Claim, 1 Drawing Sheet

OUTER WRAP CLOTHING

RELATED APPLICATIONS

The present application is a continuation-in-part of U.S. application Ser. No. 29/023,460, filed 25 May 1994, entitled OUTER WRAP CLOTHING.

BACKGROUND OF THE INVENTION

1. Field of the Invention

The present invention is related to clothing, and more particularly to an article of outer wrap clothing for children.

2. Description of the Prior Art

Infants and toddlers are vulnerable to outdoor weather conditions because of their small size and inability to recognize the dangers of exposure to cold temperatures. Accordingly, outer wrap clothing is available for protecting children against exposure to cold temperatures and rain. Examples of such clothing include infant blankets and conventional coats and jackets.

Typically, blankets are used with infants to keep them warm, and are wrapped around the infants and pinned or otherwise tucked into place to protect the infant from cold weather when carried outdoors. However, since infant blankets are not tailored to fit the human form, they are cumbersome and frequently fall open so that the infant is exposed.

Another limitation of infant blankets is that it is difficult to partially open a blanket once the child is brought inside from the cold. Instead, it is necessary to either leave the infant wrapped in the blanket or to completely remove the blanket, with no partially open condition available.

Children are often dressed in coats or wrapped in blankets when carried outside to a car. Once the child is placed in a restraint seat and the car has been heated, it is necessary to open the coat or blanket to prevent the child from overheating. With blankets, there is a tendency for the ends of the blanket to become snagged in the restraint seat making it difficult to remove or open the blanket. Likewise, with coats there is a tendency for the coat to remain closed around the child even after being unzipped due to the restraint exerted by the seat belt extending across the child's chest. Thus, it is frequently necessary to completely remove the blanket or coat before placing the child in the restraint seat, and the blanket or coat must then be put on the child before again exposing the child to the outside. Such manipulation of conventional blankets and coats is time consuming and often cumbersome, especially when the adult responsible for the child is carrying other things or has other tasks to perform.

OBJECTS AND SUMMARY OF THE INVENTION

It is an object of the present invention to provide an article of outer wrap clothing for children or handicapped adults that protects the wearer against cold temperatures and other outdoor conditions while being easy to open up for ventilation when the person wearing the clothing is seated, e.g. in a vehicle restraint seat or wheelchair.

It is another object of the present invention to provide an article of outer wrap clothing that is provided with sleeves having interior pockets for receiving the arms and hands of the wearer within the wrap.

In accordance with these and other objects evident from the following description of a preferred embodiment of the invention, an article of outer wrap clothing for children includes elongated front and back panels, each having upper and lower ends. The panels are connected together at the upper ends to define shoulders, and a head opening is formed between the shoulders for receiving the head of a child. A pair of sleeves extend laterally from the shoulders for covering the arms of the child, the sleeves each including a free end remote from the shoulders and an interior pocket provided at the free end for receiving the arms and hands of the child.

Preferably, the back panel includes a pair of flaps of a length sufficient to wrap around and over the front panel. The flaps include fasteners for fastening together when wrapped around the child. A hood can be provided adjacent the opening between the front and back panels for covering the child's head.

By providing a construction in accordance with the present invention, numerous advantages are realized. For example, by providing an article of clothing having separate front and back panels that are connected together at the shoulders, the outer wrap can be opened without completely removing the wrap from the child. Thus, once a child has been carried through the cold and placed in a vehicle restraint seat, the front panel can be lifted over the child's head so that the child is comfortable in the car and does not get overheated. Thereafter, when the child is to be removed from the restraint seat, it is only necessary to pull the front panel back down over the child's head and to fasten the flaps of the back panel around the child over the front panel.

The front panel can also be pulled down over the child's head to protect him or her from the cold without fastening the flaps of the back panel. For example, if the child is placed in a cold car, the front panel can be used to keep the child warm, but the flaps can be unfastened to allow the child to use his or her hands and arms to hold objects such as bottles and toys.

Another advantage of the present invention is that the pockets in the sleeves completely enclose the child's arms and hands so that the child's arms and hands are not exposed to inclement weather. Furthermore, the sleeves can be positioned in front of the child and tucked beneath the back panel flaps so that the child's arms and hands are held in the pockets once the flaps are fastened and do not fall out into the open cold air.

The outer wrap of the present invention also provides a design which is developmentally appropriate for babies. The outer wrap covers a baby while allowing him or her to be in a normal developmental position of flexion with his or her arms and legs drawn close to the body.

In addition to the foregoing advantages, the inventive construction permits easy access to the child within the outer wrap clothing by permitting the front and back panels to be lifted up on the child, thus enabling an adult to easily change the child's diaper without having to completely remove the outer wrap. Further, by constructing the article in the manner provided by the present invention, the clothing is reversible so that different colors or materials may be provided in the inside and outside layers of the clothing.

BRIEF DESCRIPTION OF THE DRAWING FIGURES

A preferred embodiment of the present invention is described in detail below witch reference to the attached drawing figures, wherein.

DETAILED DESCRIPTION OF THE PREFERRED EMBODIMENTS

Figure 2:
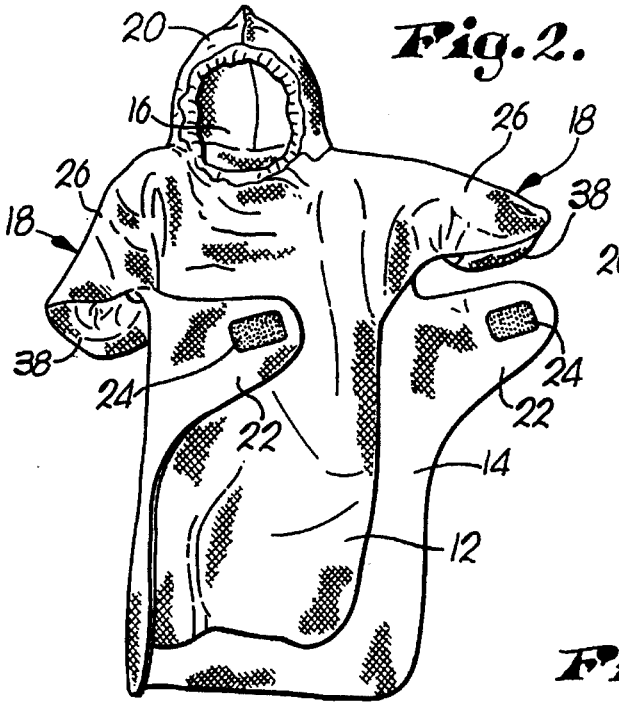
FIG. 2 is a perspective view of the outer wrap clothing shown with the back panel flaps unfastened.
Figure 1:
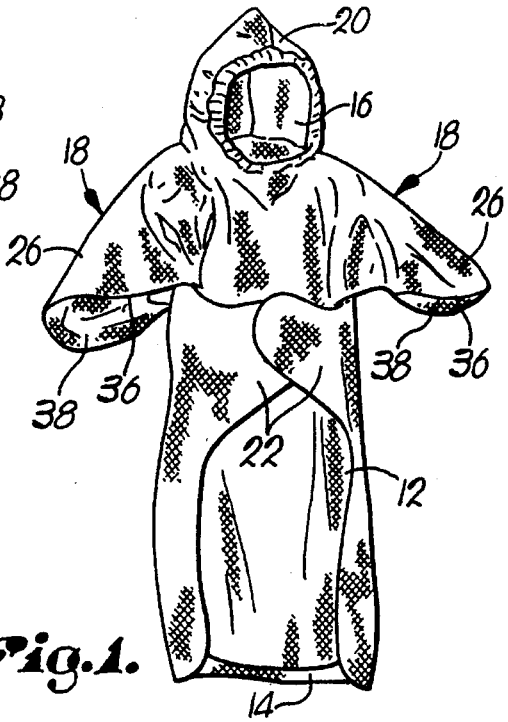
FIG. 1 is a perspective view of an article of outer wrap clothing constructed in accordance with the preferred embodiment.

Turning now to the drawings, FIG. 1 illustrates an article of outer wrap clothing constructed in accordance with the preferred embodiment of the present invention. The preferred outer wrap clothing is particularly adapted for use with children, but may be sized for use by older people. For example, the advantages of the inventive construction find utility as an article of outer wrap clothing for handicapped people who must be in and out of wheelchairs.

The clothing broadly includes a front panel 12 for covering the front portion of the child, a back panel 14 attached to the front panel 12 for covering the back portion of the child, an opening 16 intermediate the panels 12, 14 for receiving the head of a child, and a pair of sleeves 18 for receiving the arms and hands of the child. As described in more detail below, each sleeve includes a pocket 20 for receiving the arms and hands of the child within the outer wrap (see FIG. 4).

Figure 3:
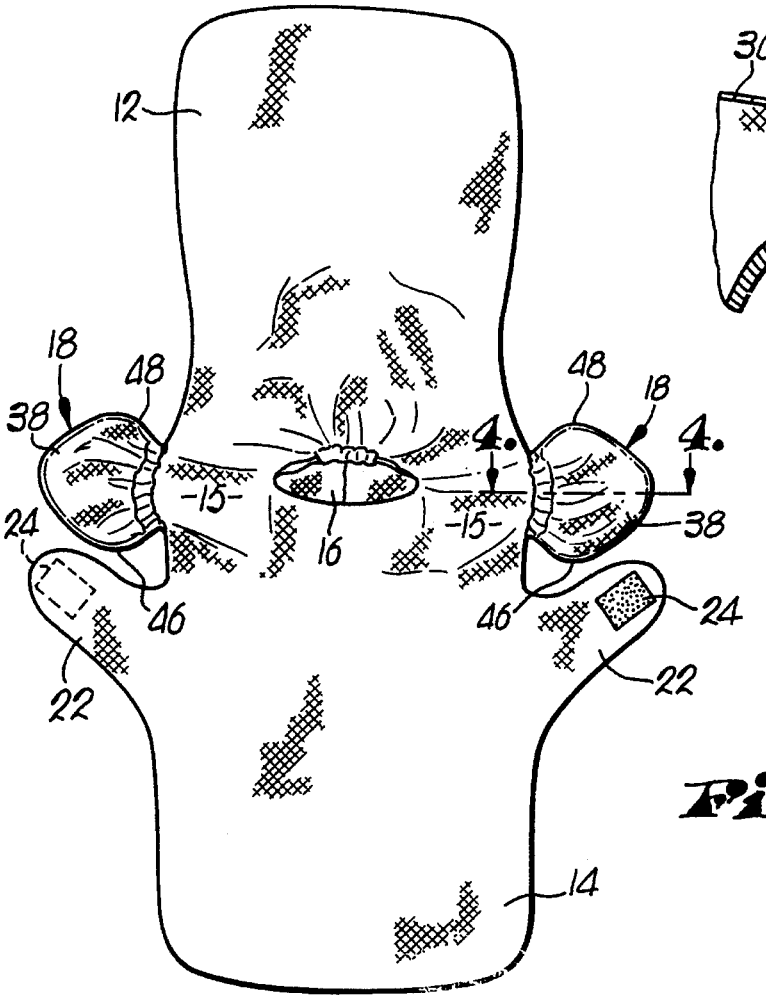
FIG. 3 is a top view of the outer wrap clothing.

In more detail, the front and back panels 12, 14 are preferably formed of a unitary piece of cloth material such as polar fleece, cotton, wool, terry cloth or polyester. As shown in FIG. 3, shoulders 15 are defined between the front and rear panels along the line of attachment between the panels, and the opening 16 is formed between the shoulders. The panels 12, 14 are rectangular in shape and are of a length sufficient to drape over and cover the child's entire body. Preferably, at least the back panel extends beyond the bottoms of the child's feet so that the panel may be wrapped around the feet to keep them warm. However, any other desired length may be employed in the panels.

The opening 16 is sized to fit over head of the child so that the shoulders 15 rest on the child's shoulders and the front and back panels 12, 14 drape over the child's body. A hood 20 is provided adjacent the opening 16 for covering the child's head, and includes a hood opening that permits the face of the child to be exposed when the hood is worn. Preferably, elastic is sewn into the hood around the hood opening so that the opening conforms to the child's face without permitting cold air into the hood.

The back panel 14 includes a pair of flaps 22 extending from its side margins. The flaps 22 are preferably integrally formed from the same piece of material as the back panel 14 and extend upward at an angle away from the side margins of the back panel 14. The flaps 22 have a length sufficient to wrap around the child's body and over the front panel 12. The ends of the flaps 22 include fasteners 24 for fastening the flaps 22 together when they are wrapped around the child. The fasteners 24 are preferably hook-and-loop type fasteners such as is marketed under the trademark VELCRO.

Figure 4:
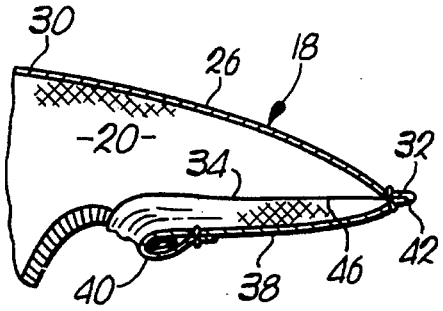
FIG. 4 is a section view of a sleeve of the outer wrap clothing taken along line 4—4 of FIG. 3.

The sleeves 18 are attached to the shoulders 15 of the clothing and are configured for receiving the hands and arms of the child. The sleeves 18 are preferably integrally formed from the same piece of material as the front and back panels 12, 14 and extend laterally outward from the shoulders 15. As best illustrated in FIG. 4, each sleeve 18 includes walls defining the interior pocket 20 for receiving the arms and hands of the child. Particularly each sleeve 18 includes an outer wall 26 presenting an inner end 30 connected to one of the shoulders of the body panels and an outer end 32 opposite the inner end and a pair of side edges 34 and 36. Each sleeve also includes an inner wall 38 of a size and shape corresponding to the size and shape of the outer wall 26 and presenting inner and outer ends 40 and 42 and a pair of spaced side edges 46 and 48. The outer and inner walls of each sleeve is connected together along the side edges and at the outer ends thereof to form the sleeve into the closed interior pocket 20 sized for receipt of both the arm and hand of a child or infant. The interior pockets 20 protect the child's arms and hands from exposure to inclement weather.

In use, the opening 16 in the outer wrap clothing is placed over the child's head so that the front and back panels 12, 14 drape over the child's body. If desired, the child's arms and hands are then inserted into the pockets 20 formed in the sleeves 18 and the sleeves may be folded over onto the front panel. Once the garment is fitted over the head of the child, the back panel flaps 22 are wrapped around the child's body and fastened in front of the child to securely hold the outer wrap in place. The outer wrap can be opened without completely removing the wrap from the child. For example, after the child is placed in a vehicle restraint seat, the back panel flaps 22 can be unfastened and the front panel 12 can be lifted over the child's head so that the child's head is pulled through the head opening 16. This exposes the front of the child's body so that he or she does not overheat once the interior of the vehicle has warmed up. Before removing the child from the car, the front panel 12 can be repositioned over the child so that he or she is once again completely covered by the outer wrap.

Although the invention has been described with reference to the preferred embodiment illustrated in the attached drawing figures, it is noted that equivalents may be employed and substitutions made herein without departing from the scope of the invention as recited in the claims. For example, the outer wrap has been described as being formed of polar fleece, cotton, wool, terry cloth or other similar material to provide for protection from cold weather. The outer wrap may also be formed from water resistant materials to protect the child from rain. Additionally, although the front and back panels 12, 14 are preferably formed from a unitary piece of material, they may also be formed from separate pieces of material which are sewn together to form a unitary body panel.

I claim:

1. An outer wrap clothing for wrapping an infant or small child comprising:

an elongated unitary body panel including a front panel for covering the front portion of the child or infant, a back panel for covering the back portion of the child or infant, and a pair of shoulders positioned between the front and rear panels, the front and rear panels being of a length sufficient to extend beyond the child's or infant's feet and being connected together only along said shoulders;

a pair of flaps attached to and extending laterally from said back panel, said flaps being of a length sufficient to wrap around and overlap said front panel;

fastening means for fastening said flaps together when overlapping said front panel;

a hood portion positioned near the midpoint of said unitary body panel including walls defining an opening for receiving the child's or infant's head and a hood for covering the child's or infants head; and a pair of sleeves extending from said unitary body for receiving the arms of the child or infant, said sleeves each including an outer wall presenting an inner end connected to one of the shoulders of the body panel, an outer end opposite the inner end, and a pair of spaced side edges, and an inner wall of a size and shape corresponding to the size and shape of the outer wall and presenting inner and outer ends and a pair of spaced side edges, the outer and inner walls of each sleeve being connected together along the side edges and at the outer ends thereof to form the sleeve into a closed pocket sized for receipt of both the arm and hand of a child or infant.

* * * * *